US005427036A

United States Patent [19]

Fee et al.

[11] Patent Number: 5,427,036

[45] Date of Patent: Jun. 27, 1995

[54] SECURE CURRENCY DEPOSIT UNITS WITH REMOVABLE SECURITY BOX

[75] Inventors: Kevin A. Fee, Marion; Daniel J. Banyas, Cedar Rapids, both of Iowa

[73] Assignee: Lefebure Manufacturing Corporation, Cedar Rapids, Iowa

[21] Appl. No.: 188,057

[22] Filed: Jan. 26, 1994

[51] Int. Cl.[6] ..... E05G 1/06

[52] U.S. Cl. ..... 109/46; 109/47; 109/53; 109/55; 109/56; 109/66; 312/211

[58] Field of Search ..... 109/45–47, 109/49, 53–57, 66, 10, 19; 232/1 D, 4 R, 4 D, 2; 312/211, 212

[56] References Cited

U.S. PATENT DOCUMENTS

| | | | |
|---|---|---|---|
| 800,558 | 9/1905 | Dunn | 232/4 D |
| 1,553,694 | 9/1925 | Johnson et al. | 109/46 |
| 1,635,736 | 7/1927 | Banta | 109/66 |
| 1,647,275 | 11/1927 | Cursons | 109/47 |
| 1,713,890 | 5/1929 | Clark | 312/212 X |
| 2,429,494 | 10/1947 | Stephens | 232/4 D |
| 3,292,849 | 12/1966 | Ewing . | |
| 3,433,185 | 3/1969 | Roberts . | |
| 3,683,826 | 8/1972 | Rieckmann | 109/46 |
| 4,491,269 | 1/1985 | Sweazey et al. | 232/1 D |
| 4,949,901 | 8/1990 | Harris | 232/1 D X |
| 5,035,187 | 7/1991 | McGunn | 109/46 |

FOREIGN PATENT DOCUMENTS

| | | | |
|---|---|---|---|
| 544725 | 8/1957 | Canada | 109/53 |
| 3414393 | 10/1985 | Germany | 109/45 |
| 31081 | 9/1909 | Sweden | 232/4 R |

*Primary Examiner*—Lloyd A. Gall

*Attorney, Agent, or Firm*—Simmons, Perrine, Albright & Ellwood

[57] ABSTRACT

A cashier's console includes in a vertically stacked arrangement a safe or secure deposit base, a security box and a cash drawer. The security box includes a number of currency bill insertion slots which are arranged parallel to an upper front edge of the security box but are recessed inward from the upper front edge of the security box. A face plate of the cash drawer is sloped toward the currency insertion slots to function as a guide surface for inserted bills. The guide surface raises in effect the height from which bills may be conveniently inserted into the insertion slots. The effective upward positioning of the insertion heights makes it easier for a cashier to sort money into the slots on a daily basis, thereby raising the efficiency of the insertion operation. Vertical guides provide lateral guiding action to further increase the efficiency of the operation. The number of slots are chosen to permit commonly received paper currency to be sorted and secured within the security box in separate compartments.

8 Claims, 2 Drawing Sheets

SECURE CURRENCY DEPOSIT UNITS WITH REMOVABLE SECURITY BOX

BACKGROUND OF THE INVENTION

This invention relates to temporary currency storage units, as used in banks or other currency transaction businesses.

Commercial establishments which handle substantial sums of money are, of course, concerned about protecting current holdings of cash or similar negotiable instruments from being mishandled or stolen. Security boxes are known to have been mounted, hidden from public view, to undersides of cashier's counters. To alleviate a need to open a known type security box to deposit funds, the security box has been furnished with a slot for depositing currency. It is further known to deposit money through a slot in a table surface which slot coincides with a similar slot in the removable security box mounted within a mounting frame to the underside of the table. Also, efforts have been made to prevent tampering with security boxes. Thus, as shown in U.S. Pat. No. 3,292,849, on removal of a security box from a deposit position beneath a table, a closure of the slot in the security box occurs.

U.S. Pat. No. 3,433,185 pertains to a similar security box installation sought to provide a security box mountable under tables to make use of a currency deposit slot within the tables. The disclosed security box has also a protective slide for a currency slot. Protecting the security boxes from being tampered with is of less concern in establishments in which the person depositing funds into the security box remains accountable for the funds and also works in the vicinity of the location of the security box.

However, various types of commercial establishments which handle substantial sums of money may require protection in day-to-day operations against walk-in robberies. Since robberies are crimes of convenience, protection may be found in temporary inaccessibility of spoils of such crimes. Security boxes may serve such a need in providing delay in immediate access to currency. On the other hand, persons working in such establishments must also be able to handle currency in a commercially efficient manner, so as to contain handling costs. Thus, the use of a security box must not interfere with sorting of cash receipts.

SUMMARY OF THE INVENTION

It is an object of the present invention to free a person interacting in a cash-receiving transaction with the public from being assaulted because of such person having immediate access to large sums of cash.

It is another object of the invention to provide a person interacting with the public in money-receiving transactions with a means for sorting currency bills according to denominations and to securely store the sorted bills.

It is yet another object of the invention to provide a security box which may be locked into place during use and which is independently locked such that it may not be opened by the person handling money transaction at the location of the security box.

It is a further object of the invention to provide the security box with a plurality of receiving compartments, each receiving compartment allowing a different currency bill to be inserted.

It is another object of the invention to locate a security box at a cashier's station adjacent a cashier's counter and beneath a utility or change drawer.

It is a further object to provide a depository for currency bills which may be used by a bank teller or cashier to increase such person's efficiency in depositing the currency bills without jeopardizing the security of the deposited bills.

It is yet another object of the invention to provide currency insertion slots with convenient guiding surfaces for bills being inserted into a security box.

According to the invention a currency deposit console includes a secure deposit base, a cash drawer and a removable security box disposed between the cash drawer and the secure deposit base in vertical arrangement. A face of the cash drawer is recessed inward toward an upper edge recessed currency deposit access location to provide a guiding surface for currency deposits into the security box.

According to one aspect of the invention, the security box advantageously includes a plurality of compartments and a corresponding plurality of access slots. Using each of the access slots for the deposit of a particular, designated denomination of currency bill, a person handling large amounts of currency may presort currency deposits according to denominations to facilitate accounting for receipts at the conclusion of work shifts. The recessed face of the cash drawer may include vertical guide partitions to separate each of the slots in the security box from an adjacent slot.

Other features and advantages of the invention will become apparent from reading the detailed description below.

BRIEF DESCRIPTION OF THE DRAWINGS

The detailed description of the invention may be read in reference to the appended drawing wherein.

DETAILED DESCRIPTION OF THE INVENTION

Figure 1:
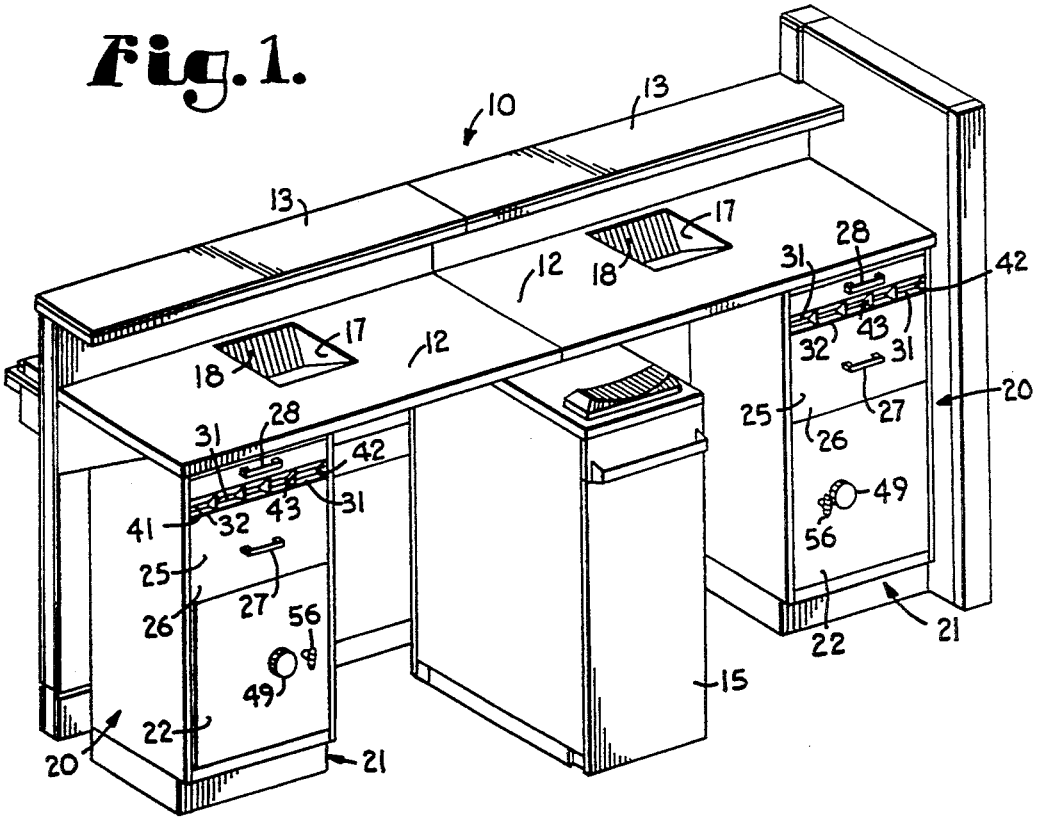
FIG. 1 is a pictorial representation of a teller's counter or cashier's station showing an arrangement with teller's consoles or cashier's consoles which include features of the present invention.

Referring to FIG. 1, there is shown a teller's station, designated generally by the numeral 10, as it may be found in a banking facility or at a cashier's station of certain business establishments with separate currency transaction services. The teller's station 10 is a duplex teller's station, which includes two cashier's work stations with two counters 12 and their transaction counters 13 arranged side-by-side. The two cashier's stations shown, share a common cash dispatch unit 15. The cashier's counters 12 may be equipped with recesses 17 for viewing a recessed computer display screen which may be located at 18. Each of the work stations shows a currency deposit console or cashier's console which is designated generally by the numeral 20. The cashier's console 20 features in a lower portion 21 a secure deposit base 22 similarly to state-of-the-art secure deposit bases. At an upper end, adjacent the cashier's counter 12 there is a cash or change drawer 24.

Known cashier's consoles feature a combination of an upper cash drawer and a lower secure deposit base. Secure deposit bases are small safes with reinforced walls and doors equipped with digital or rotary combination door locks. A secure deposit base is typically paired in a state-of-the-art cashier's console with a cash drawer. The cash drawer is necessarily located to be accessible directly below a countertop. The cash drawer is accessed frequently by a person working at the cashier's station. The cash drawer generally retains various banking transaction forms, check receipts, a drawer inset with hard currency, and other cash accounting forms, and the like, as may be used by a cashier or bank teller during normal operations. Larger currency deposits or the like would according to practices be deposited in the secure deposit base. Efficiency of banking operations necessitates that cash receipts are expeditiously stored in a manner in which they can be readily accounted for at a later time, after closing hours or during shift changes, and transferred at such later time to a central secure storage safe. No large deposits would generally be retained in the secure deposit base for extended periods beyond normal business hours. However, during deposits and for purposes of transfer, the secure deposit base needs to be opened. It is in this regard that the present invention provides advantages as will become apparent.

The cashier's console 20 includes a security box 25 which is located, when inserted into the cashier's console 20, between the change drawer 24 and the secure deposit base or safe 22. A preferred embodiment of the security box 25 is of a shape which is best described as being generally rectangular. Its width is substantially that of the cashier's console 20, fitting into an opening provided thereby. The security box 25 has a frontal surface or face plate 26 which coincides, when the security box 25 is disposed fully inserted within the cashier's console 20 with a frontal plane of the cashier's console and blends generally with the decor of the cashier's console 20 as a whole. The security box 25 has a handle 27 similar to a frontal handle 28 on the change drawer 24, which lends the security box 25 the appearance of another, central drawer of the cashier's console 20. The handle 27 allows the security box 25 to be pulled out of the cashier's console 20 as if it were a cabinet drawer, and further permits the security box 25 to be lifted from and be completely removed from the cashier's console 20 to be carried in a locked condition to a secure place.

The security box 25, in accordance herewith, features in an upper wall 30 a plurality of insertion slots 31 which are recessed from the front face 26 and are disposed along a line parallel to the front face 26 adjacent an upper, outer edge 32 of the security box 25. In an embodiment shown in FIG. 1, there are, for example, five separate slots 31. Each of the slots 31 has a length sufficient to permit a currency bill to be longitudinally inserted through the respective slot 31. Four vertical partitions 33 form five correspondingly separate currency compartments within the security box 25. Thus a cashier, bank teller or person receiving cash in bills of various denominations may insert the bills through a preselected one of the plurality of slots 31, depending on the denomination of the bill, thereby sorting the bills according to denominations. Received checks may be kept in the change drawer 24 or in the secure deposit base 22, depending on the volume of receipts. Since sorting currency bills is one of the tasks of accounting for the cash receipts, the ability to sort bills in an ongoing manner permits a bank teller, cashier or currency service counter person to allocate her or his time more efficiently than might otherwise be possible.

A problem associated with locating the security box 25 below the cash drawer 24 relates to providing convenient access to the slots 31 to efficiently deposit bills. Since an object of the invention relates to increasing the efficiency of cashiers or bank tellers without sacrificing the security of deposited funds, access to the security box 25 to readily deposit funds becomes critical. The height of the cashier's counter 12 is selected to be at an optimum working height, the height of the table providing the access height to the cash drawer 24. A convenient depth for the cash drawer 24 is approximately four inches. The presence of the cash drawer 24 makes it inconvenient to provide access to the security box 25 through the cashier's counter 12 as such. Frontal access to the security box 25 to be at an optimum position is therefore adjacent the uppermost frontal edge 32 of the security box 25.

Access to the deposit slots 31 is enhanced by a frontal face 35 of the cash drawer 24, a lower part of which is inwardly sloped to provide a downwardly and inwardly slanted guide surface 36 to each of the currency deposit slots 31. The precise angle of slant of the guide surface 36 away from a vertical plane is, of course, a matter of choice. A preferred range of angles of slant may lie between twenty and forty degrees from the vertical. A thirty degree angle may be a good choice for the angle of slant of the guide surface 36, as is shown. The cash drawer handle 28 may then be located conveniently above the sloped guide surface 36 on an upper vertical face of the frontal face 35. In addition to providing the guide surface 36 to facilitate the insertion of bills into the slots 31, lateral guiding is advantageously provided by vertical left and right end guides 41 and 42, and by center guides 3. The vertical left and right end guides 41 and 42 have each a single laterally sloped guide surface 44 which tapers toward the open space in front of an adjacent slot 31. Each of the center guides 43 have two of such inwardly tapering guide surfaces 44 which diverge inwardly with respect to each other and guide a currency bill to be inserted laterally toward a respective one of the insertion slots 31.

The deposit slots 31 themselves, though adjacent the upper, outer edge 32 of the security box 25, are offset inwardly, away from the outer edge 32. A surface 46 of the security box 25 which extends between the upper, outer edge 32 of the security box 25 and the line of the insertion slots 31 also functions as a lower guide surface 46 which is inwardly sloped toward the slots 31. The lower guide surface 46 may be sloped at an angle which forms a right angle with the sloped guide surface 36 on the cash drawer 24. Though preferred slopes are specified herein, it should be understood that the guiding function of the sloped surfaces can be performed within a wide range of slopes at which the respective guides may be disposed. Thus the particular angles are preferred but are given for illustrative purposes only, in that they may be altered within the scope of the invention. With respect to the preferred example, the structural elements to provide guiding for the insertion of currency bills into the respective insertion slots 31 are shared between the cash drawer 24 and the security box 25.

Figure 2:
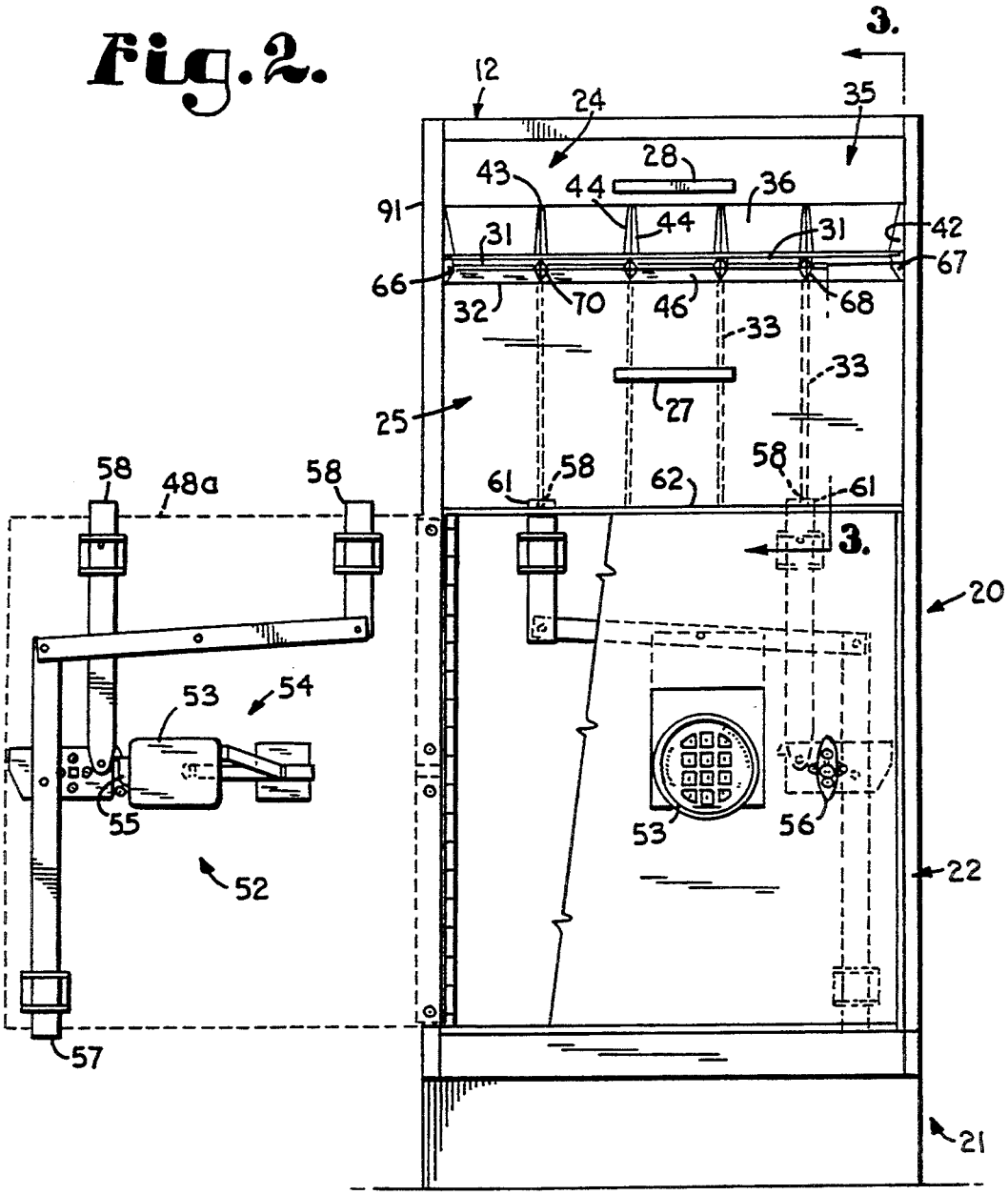
FIG. 2 is a frontal view of one of the cashier's console's depicted in FIG. 1, showing detailed features of the present invention in greater detail.

Referring now to FIG. 2, there is shown a frontal view of the cashier's console 20. The secure deposit base 22 is shown with a broken view of a safe door 48.

FIG. 1 shows the safe door 48 as having a rotary combination lock 49. In FIG. 2, the safe door 48 is equipped with a state-of-the-art digital combination lock 52. In an alternate, open position of the safe door 48*a*, a typical locking mechanism 52 is shown for illustrative purposes. The digital combination lock 52 may be unlocked by a combination of numerals selected on a keyboard 53, energizing a retraction mechanism 54 to retract a latch lever 55 out of a latching position. With the latch lever 55 withdrawn toward the digital combination lock 52, a door latch handle 56 may be turned, typically through a quarter turn, to retract a number of lock bolts 57 and 58, three are shown as a representative, preferred example. In the illustration of FIG. 2, upward-acting lock bolts 58, when moved to close the safe door 48, move upward to also engage latch recesses 61 in a lower wall 62 of the security box 25. Thus, when the secure deposit base 22 is locked, an inserted security box 25 is also safely locked into the cashier's console 20. Conversely, when it is desired to remove the security box 25, a bank teller or cashier will need to unlock the safe 22 and turn the handle 56 to withdraw the lock bolts 58. Concurrently locking the safe 22 and the security box 25 provides a desired safety level for the security box 22 in banks or other commercial establishments which may have other, additional security measures available.

FIG. 2 shows the security box 25 and the described guiding surfaces in greater detail. The lower guide surface 46 of the security box 25 has mounted thereto lower lateral left, right and center guide extensions 66, 67 and 68, respectively. The guide extensions have respective, sloping lower vertical guide surfaces 69 which are substantially coextensive of the guide surfaces 44 of the left, right and center guides 41, 42 and 43 of the cash drawer 24. The lower guide surfaces 69 may be disposed at a small offset with respect to the corresponding upper guide surfaces 44, the upper guide surfaces 44 terminating in a lower edge 70 which forms a ledge with an adjacent one of the lower guide surfaces 69, such that a downwardly inserted currency bill does not catch at a parting line along the lower edge 70 of the cash drawer 24. As may be seen from FIG. 2, the described inwardly sloping guides leading to the recessed insertion slots 31 functionally tend to raise the physical location for insertion of the currency bills to coincide at least partially with the vertical location of the cash drawer 24.

Figure 3:
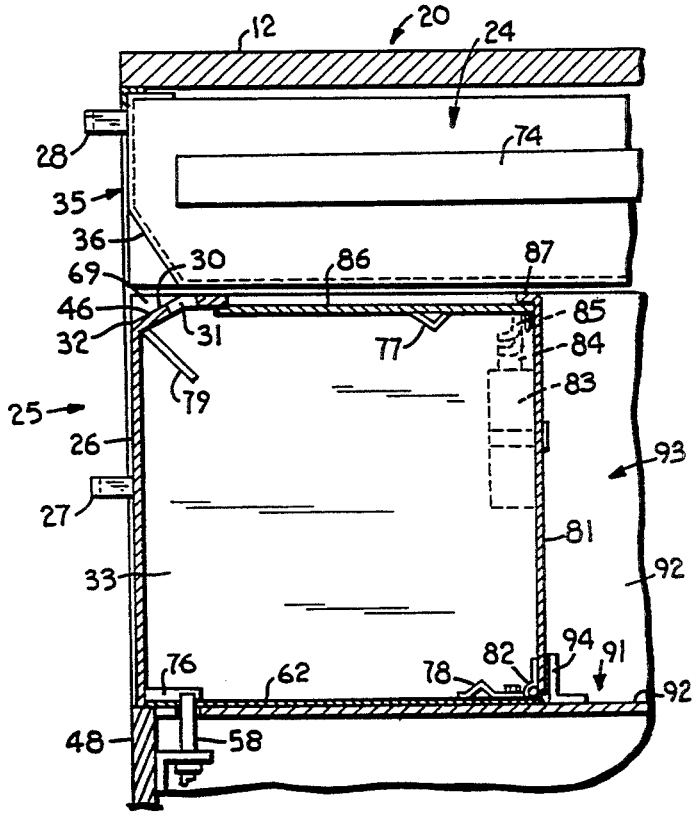
FIG. 3 is a partial section of the cashier's console taken along the lines "3—3" in FIG. 2.

FIG. 3 shows a partial, sectional side view of the cash drawer 24 and the security box 25, showing, in particular, the advantageous arrangement of the recessed insertion slots 31 and the sloped guide surface 36, the combination of which raises the insertion region for currency bills to coincide with at least the height of the lower portion of the cash drawer 24. The cash drawer 24 is shown disposed directly beneath the cashier's counter 12. The cash drawer 24 may be slidably hung in any of a number of known ways, a typical bearing slide 74 being shown as an example. The pull handle 28 is shown disposed high and away from the bill insertion path.

The security box 25 is shown as having a substantially square cross section. The cross-sectional shape is not critical to the invention, the square cross-sectional shape being shown as a currently preferred shape and as an illustrative example of a representative shape of the security box 25. The location of the partitions 33 may require cutouts 76 adjacent the bottom wall 62 of the security box 25 to allow for a locking engagement of the lock bolts 58. The partitions may be held in place by retention lugs or projections 77 and 78 and between baffle plates 79 adjacent the upper front edge 32 of the security box 25. The baffle plates may be provided to also serve as a bill insertion guide 79 internal to the security box 25. Access to the security box 25 is preferred to be from a rear or internal side, as shown, such that the security box may not be accessed while it is locked into the cashier's console 20. A preferred access is shown as a downwardly pivoting door 81, which pivots about a hinge 82 mounted to the bottom wall 62. A typical, internally mounted key lock 83 operates a bolt 84 which moves upward into a locking position against an upper latch 85 on a rearward extension 86 of the upper wall 30. The rearward extension may be of a lesser strength of material than the forward portion 30 within which the slots 31 are disposed. The door 81 may be strengthened by a flange 87 which overlaps the upper wall 86 of the security box 25.

The described combination of the secure deposit base 22, the security box 25 and the cash drawer 24 are arranged in vertical relationship to each other by a console cabinet frame which is designated generally by the numeral 91. Supported by the frame 91, console walls 92 are preferably of steel to provide reasonable strength and resistance to forced entry. The walls 92 provide a cavity 93 within which the security box 25 will be inserted. FIG. 3 shows a backstop 94 which aligns the frontal surface 26 of the security box 25 substantially in the same plane with the outer surface of the safe door 48. Also, the full insertion of the security box 25 aligns the slots 31 with the described guide surfaces in the cash drawer 24.

Though certain variations and modifications have already be referred to or described, it is understood various other changes and modifications in the use and implementation of the described embodiments are possible without departing from the spirit and scope of the invention as set forth in the claims.

What is claimed is:

1. A cashier's console comprising in vertical arrangement:

a secure deposit base disposed at a lower end of the cashier's console;

a removable security box disposed adjacent the secure deposit base, the security box being generally rectangular in shape and having a face plate disposed in a frontal plane of the cashier's console, a plurality of insertion slots disposed in an upper wall of the security box, the slots being recessed away from the frontal plane of the cashier's console; and a cash drawer disposed above the removable security box, the cash drawer having a lower portion of a face plate disposed at an angle sloping downwardly inward toward the insertion slots of the security box and forming a guide surface to guide currency bills being inserted toward the insertion slots.

2. The cashier's console according to claim 1, wherein the security box has an upper frontal edge between the upper wall and the face plate and the slots are recessed inward from the frontal edge, the upper wall between the insertion slots and the frontal edge being sloped upwardly and inwardly from the frontal plane of the cashier's console.

3. The cashier's console according to claim 2, wherein the upper wall between the insertion slots and the frontal edge is disposed substantially at a right angle with respect to the guide surface formed by the lower portion of the face plate of the cash drawer.

4. The cashier's console according to claim 2, wherein the security box comprises a plurality of internal partitions dividing the interior of the security box into a plurality of internal compartments, each of the compartments being associated with one of the insertion slots of the security box.

5. The cashier's console according to claim 4, wherein the plurality of insertion slots is comprised of five insertion slots and the plurality of internal partitions is comprised of four partitions dividing the interior of the security box into five separate compartments, each compartment being associated with one of the five insertion slots.

6. The cashier's console according to claim 4, further comprising vertically disposed guides mounted to the exterior of the guide surface formed of the lower portion of the face plate of the cash drawer and spaced adjacent lateral edges of the plurality of the insertion slots, the vertically disposed guides having guide surfaces for laterally guiding currency bills toward the insertion slots.

7. The cashier's console according to claim 6, further comprising vertically disposed lower guides mounted to the sloped portion of the upper wall of the security box and vertically aligned with the vertically disposed guides mounted to the exterior of the guide surface formed of the lower portion of the face plate of the cash drawer, the lower guides coacting with the guides mounted to the exterior guide surface formed of the lower portion of the face plate of the cash drawer to guide currency bills toward the insertion slots.

8. The cashier's console according to claim 1, wherein the secure deposit base comprises a combination lock and a locking mechanism, the locking mechanism being operable to lock the security box into position within the cashier's console.

* * * * *

UNITED STATES PATENT AND TRADEMARK OFFICE

CERTIFICATE OF CORRECTION

PATENT NO. : 5,427,036

DATED : June 27, 1995

INVENTOR(S) : Kevin A. Fee et al.

It is certified that error appears in the above-identified patent and that said Letters Patent is hereby corrected as shown below:

Column 4, line 37: delete "3" and insert therefor --43-- .

Signed and Sealed this

Seventeenth Day of October, 1995

Bruce Lehman

*Attest:*

BRUCE LEHMAN

*Attesting Officer*

*Commissioner of Patents and Trademarks*